US005184374A

United States Patent [19]

Barauke et al.

[11] Patent Number: 5,184,374

[45] Date of Patent: Feb. 9, 1993

[54] DRAFTING UNIT WITH AT LEAST ONE CLEANING BELT

[75] Inventors: Norbert Barauke, Donzdorf; Kurt Lang, Lauterstein, both of Fed. Rep. of Germany

[73] Assignee: Spindelfabrik Sussen, Schurr, Stahlecker & Grill GmbH, Fed. Rep. of Germany

[21] Appl. No.: 772,096

[22] Filed: Oct. 7, 1991

[30] Foreign Application Priority Data

Oct. 6, 1990 [DE] Fed. Rep. of Germany ..... 4031769

[51] Int. Cl.[5] ..... D01H 5/60

[52] U.S. Cl. ..... 19/262

[58] Field of Search ..... 19/262, 263, 264, 265; 474/101, 132; 15/256.52, 256.53

[56] References Cited

U.S. PATENT DOCUMENTS

| | | | |
|---|---|---|---|
| 2,593,478 | 4/1952 | Newton | 19/262 |
| 2,951,268 | 9/1960 | West | 19/264 |
| 3,838,476 | 10/1974 | Gort | 19/265 |
| 4,317,261 | 3/1982 | Adamson | 19/265 |
| 4,370,781 | 2/1983 | Murao | 19/262 |
| 4,706,339 | 11/1987 | Eder | 19/265 |
| 4,985,967 | 1/1991 | Stahlecker et al. | 19/262 |
| 5,088,157 | 2/1992 | Yasuda et al. | 19/263 |

FOREIGN PATENT DOCUMENTS

| | | | |
|---|---|---|---|
| 234282 | 3/1986 | Fed. Rep. of Germany | 19/265 |
| 3522504 | 1/1987 | Fed. Rep. of Germany . | |
| 879064 | 2/1943 | France | 19/265 |

*Primary Examiner*—Andrew M. Falik
*Assistant Examiner*—Michael A. Neas
*Attorney, Agent, or Firm*—Evenson, Wands, Edwards, Lenahan & McKeown

[57] ABSTRACT

In the case of a drafting unit for a spinning machine comprising several top rollers and bottom rollers, continuous cleaning belts are provided which are arranged and held in such a manner that, because of the inherent weight of at least one of the deflecting rollers, they are tensioned, on the one hand, and, on the other hand, are brought to rest against the top rollers or bottom rollers.

19 Claims, 1 Drawing Sheet

DRAFTING UNIT WITH AT LEAST ONE CLEANING BELT

BACKGROUND AND SUMMARY OF THE INVENTION

The invention relates to a drafting unit of a spinning machine having several top rollers and bottom rollers and having at least one continuous cleaning belt which is placed around two deflecting rollers held at their shafts, which is driven by means of a friction drive, and which rests with one end approximately tangentially on several top rollers or several bottom rollers.

It is known to clean bottom rollers and/or top rollers of drafting units by means of cleaning belts, so-called cleaning rags. In this known construction of German Patent Document DE-A 35 22 504, it is provided that the cleaning belt is placed around two deflecting rollers which are held on the loading arm which carries the top rollers by means of spring elements. The spring elements provide that the cleaning belt is tensioned. The drive of the cleaning belt is derived from a top roller.

It is an object of the invention to develop a drafting unit of the initially mentioned type in such a manner that a simple holding device is provided for the cleaning belt or belts, in which case, however, the cleaning function is not impaired at the same time.

This object is achieved in that at least one of the deflecting rollers is held in the vertical direction by means of the cleaning belt wound around it and, by means of a guide applied to its shaft, is guided such that an end of the cleaning belt rests against the top rollers or the bottom rollers.

By means of this development, it is achieved that, on the one hand, the cleaning belt is tensioned by the inherent weight of one deflecting roller so that, on the one hand, a secure transmission of the driving forces to the cleaning belt is ensured while, on the other hand, this cleaning belt also rests with sufficient force against the surface of the top rollers or bottom rollers to be cleaned. Spring elements or the like for the contact-pressing or tensioning of the cleaning belt are not required.

In a further development of the invention it is provided that one of the deflecting rollers is supported against a drive shaft. The cleaning belt therefore receives its own drive which is independent of the drive of the top rollers or bottom rollers so that speeds and/or moving directions which are suitable for the cleaning function can be selected.

In an expedient development of the invention, it is also provided in this case that the deflecting roller supported against the drive shaft is provided with ring collars moving against the drive shaft. By way of these ring collars, on the one hand, the friction drive takes place from the drive shaft while, on the other hand, the ring collars also have the purpose of causing the cleaning belt to be guided laterally.

Other objects, advantages and novel features of the present invention will become apparent from the following detailed description of the invention when considered in conjunction with the accompanying drawings.

DETAILED DESCRIPTION OF THE DRAWINGS

Figure 1:
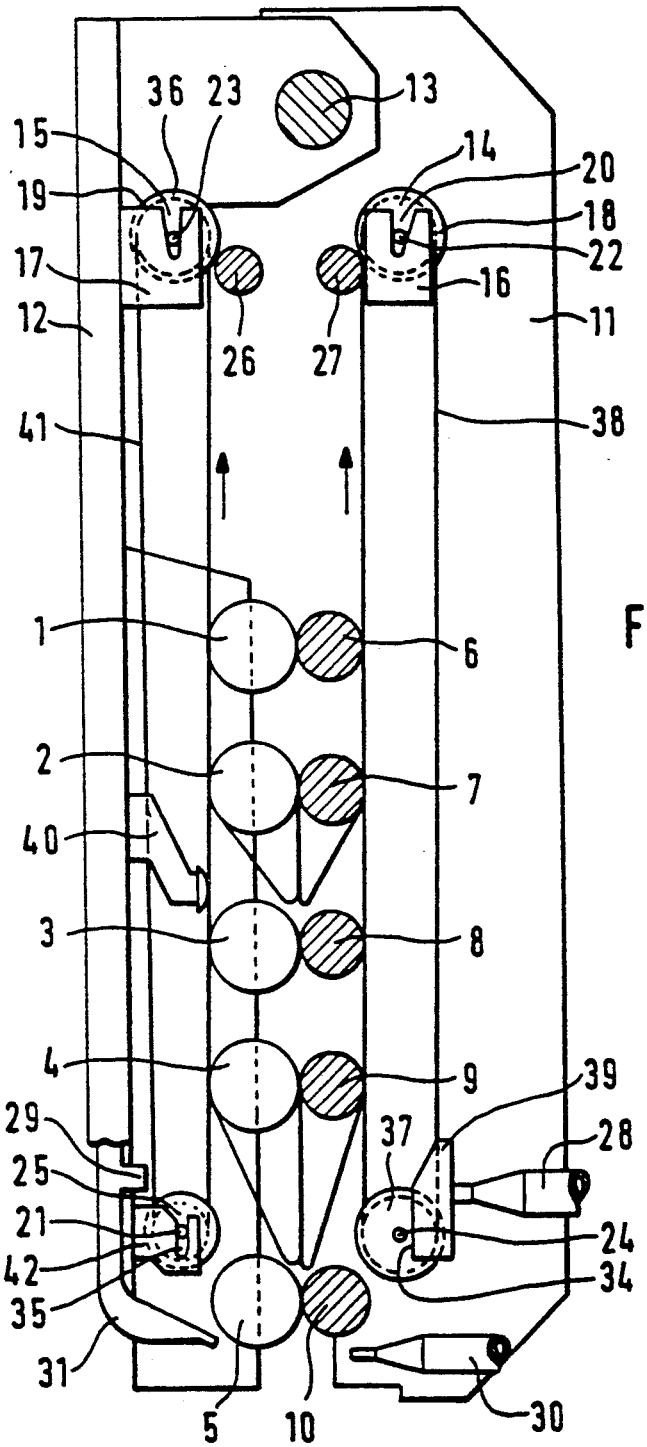
FIG. 1 is a schematic representation of a lateral view of a drafting unit which is provided with one cleaning belt respectively for the top rollers as well as for the bottom rollers, constructed according to a preferred embodiment of the invention.

The drafting unit illustrated in FIG. 1 is constructed as a so-called five-cylinder drafting unit in a manner that is known per se. The drafting unit has five top rollers (1 to 5) to which five bottom rollers (6 to 10) are assigned. The bottom rollers (6 to 10) are constructed as cylinders which extend through in the longitudinal direction of the machine and are driven at the machine end. The top rollers (1 to 5), in each case, extend only along the area of a spinning station. However, they are combined with corresponding top rollers of a second drafting unit to form so-called top roller pairs. In this case, the top rollers (1 to 5) are in each case arranged in pairs on a common shaft which is held by means of a top roller load support 12 which is shown only schematically. This load support 12 can be swivelled about a shaft 13 that is parallel to the bottom rollers (6 to 10) so that the top rollers (1 to 5) can be moved away from the bottom rollers (6 to 10) for interrupting the operation of the drafting unit. The bottom rollers (6 to 10) and the shaft 13 are disposed in a machine frame in so-called roller stands 11.

As mentioned above, the drafting unit is constructed in the known manner; that is, the top rollers (1 to 5) are provided with a rubber-elastic covering, while the bottom rollers (6 to 10) have a ribbing or diagonal knurling. In addition, as indicated in FIG. 1, apron guides are provided in at least two drafting zones.

Suction nozzles 30, 31 are assigned to the pair of delivery rollers, that is, to the top roller 5 and the bottom roller 10. In a manner not shown in detail, these suction nozzles 30, 31 are connected to a vacuum source. These suction nozzles 30, 31 have the purpose of keeping the delivery roller pair free of fiber fly. In addition the suction nozzle 30 assigned to the bottom roller 10 has the purpose of taking in and leading away drafted sliver which the drafting unit continues to deliver in the case of a yarn breakage or the like.

Cleaning belts 38, 41 are assigned to the other top rollers (1 to 4) and also to the bottom rollers (6 to 9). These cleaning belts 38, 41 may also be called cleaning rags. They are continuous and are each wound about two deflecting rollers 14, 37; 15, 25. The two cleaning belts 38, 41 as well as their bearings, which will still be explained here, are arranged to be largely mirror-symmetrical with respect to the drafting plane of the drafting unit.

The upper deflecting roller 14 of the cleaning belt 38 is guided with its shaft 22 in a slot guiding device 20 of a holder 16 which is mounted on the machine frame. The deflecting roller 14 is provided with lateral ring collars 18 which, on the one hand, laterally guide the cleaning belt 38 and which, on the other hand, are supported on a drive shaft 27 which extends in parallel to the bottom rollers (6 to 9) through in the longitudinal direction of the machine and is driven at the machine end.

The second deflecting roller 37 hangs in the cleaning belt 38 so that this deflecting roller 37, which is also provided with lateral ring collars, is held by the cleaning belt 38 in the vertical direction. The shaft 2 of the deflecting roller 37 rests against a guiding edge 34 of a holder 39 which guides the deflecting roller 37 in the horizontal direction. The guide 39 is arranged on the side of the shaft 24 situated opposite the bottom rollers (6 to 9). The guide 39 can expediently be adjusted in the horizontal direction so that the relative position of the shaft 24 and thus also of the deflecting roller 37 and therefore also of the cleaning belt 38 can be adjusted with respect to the circumferences of the bottom rollers (6 to 9). The inherent weight of the deflecting roller 37, on the one hand, has the purpose of tensioning the cleaning belt 38 and, on the other hand, of generating a contact pressure force by means of which one end of the cleaning belt 38 rests against the circumferential surfaces of the bottom rollers (6 to 9).

The holder 16 together with the guide 20 is arranged in such a manner that the two ends of the cleaning belt 38 extend at least approximately in parallel to a tangential plane which rests against the circumferential surfaces of the bottom rollers (6 to 9). In order to ensure that the cleaning belt 38 rests against the first bottom roller 6 with sufficient force, the deflecting roller 14 is expediently arranged to be slightly offset in the transverse direction with respect to the bottom rollers (6 to 9).

As can be recognized from the above, only the guiding edge of the slot guiding device 20 which faces the drive shaft 27 is operative so that the holder may be constructed in a simplified manner; that is, instead of the slot guiding device 20, only a guiding edge may be provided which faces the drive shaft 27.

A suction nozzle 28 which, in a manner not shown in detail, is connected to a vacuum source, is assigned to the cleaning belt 38 which is preferably driven in a moving direction which is opposite to the rotating direction of the bottom rollers (6 to 9). Suction nozzle 30 may also be used as the suction nozzle assigned to the cleaning belt 38 if this cleaning nozzle 30 is pivotally held in such a manner that, during the normal operation, it is assigned to the cleaning belt 38 while, in the case of a yarn breakage, it is applied to the bottom roller 10 of the delivery roller pair.

The cleaning belt 41, which is assigned to the top rollers (1 to 4), is arranged and held in a manner which in principle is identical to that described with respect to cleaning belt 38. However, since its holders 17 are mounted on the supporting and loading arm 12 which can be swivelled about the shaft 13, the holders 17, 42 are provided with slot-shaped guides 19, 35 so that the deflecting rollers 15, 25 will then also still be held when the supporting and loading arm 12 is swivelled away and the cleaning belt 41 does not rest against the top rollers (1 to 4), and the deflecting roller 15 with ring collars 36 does not rest against the pertaining drive shaft 26.

Since, for the cleaning of the top rollers (i to 4), which are provided with a covering, higher cleaning forces may under certain circumstances be required, a yoke 40 is mounted on the supporting and loading arm 12 in the case of the embodiment according to FIG. 1. This yoke 40 places itself by means of a shoe from the inside against the travel path side of the cleaning belt 41 moving against the top rollers (1 to 4). For cleaning the cleaning belt 41, a suction nozzle 29 is also assigned to the cleaning belt 41.

Figure 2:
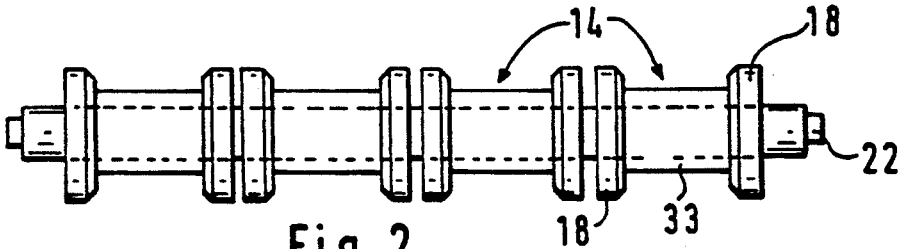
FIG. 2 is a radial view of several deflecting rollers for cleaning belts of several drafting units which are arranged on a common shaft.

It is possible, particularly for the deflecting rollers 14, 37 which are assigned to the stationary bottom rollers (6 to 9), to provide a common shaft 22 onto which several deflecting rollers 14 are fitted, as illustrated in FIG. 2. The shaft 22 extends along the length between two not shown drafting unit frames on which holders 16 or 39 made of plastic are mounted. These holders 16 or 39 receive the journals of the shaft 22. In the area of the ring collars 18 and also in the area of the running surface 33, the deflecting rollers 14 are expediently coated with a rubber-elastic material or are made in one piece from a rubber-elastic material.

Although the arrangement of the cleaning belts 38, 41 and their holding devices were explained in connection with a vertically aligned drafting unit according to FIG. 1, it is also contemplated to provide an arrangement and holding device for horizontally aligned or sloped drafting units which is substantially similar in principle. Since, however, in this case, a cleaning belt must be placed against the bottom rollers from below, it may, under certain circumstances, also be expedient to provide a stationary deflecting guide by means of which the end of the cleaning belt assigned to the bottom rollers is held in the area of the bottom rollers. The continuous cleaning belts 38, 41 expediently consist of a polyester cotton fabric which is provided with a polyurethane coating.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A drafting unit for a spinning machine comprising:

a plurality of top drafting rollers, a plurality of bottom drafting rollers disposed opposite respective top drafting rollers to define a sliver path therebetween, a continuous cleaning belt being guided to travel around respective top and bottom deflecting rollers, and a belt guide for guiding the cleaning belt to engage against a plurality of said drafting rollers to effect cleaning thereof, wherein the bottom deflecting roller is floatingly supported vertically below the top deflecting roller by means of the cleaning belt travelling around said bottom deflecting roller with the weight of said bottom deflecting roller serving to tension the cleaning belt.

2. A drafting unit according to claim 1, wherein said belt guide is disposed adjacent said bottom deflecting roller.

3. A drafting unit according to claim 1, comprising a cleaning belt drive shaft drivingly engageable with one of the deflecting rollers to drive the cleaning belt.

4. A drafting unit according to claim 1, comprising a cleaning belt drive shaft drivingly engageable with the top deflecting roller to drive the cleaning belt.

5. A drafting unit according to claim 4, wherein the top deflecting roller is provided with a ring collar engageable with the cleaning belt drive shaft.

6. A drafting unit according to claim 3, wherein the top deflecting roller is supported in a guide which exhibits a guide surface which extends diagonally with respect to said cleaning belt drive shaft in driving engagement with the top deflecting roller.

7. A drafting unit according to claim 5, wherein the top deflecting roller is supported in a guide which exhibits a guide surface which extends diagonally with respect to said cleaning belt drive shaft in driving engagement with the top deflecting roller.

8. A drafting unit according to claim 1, wherein deflecting rollers of several adjacent drafting units are arranged on a common shaft.

9. A drafting unit according to claim 1, wherein at least one suction nozzle is assigned to the cleaning belt.

10. A drafting unit according to claim 2, comprising a driving device for driving said cleaning belt drive shaft such that the cleaning belt has a speed difference with respect to the speed of the surface of the drafting rollers being cleaned thereby.

11. A drafting unit according to claim 1, wherein two of said cleaning belts are provided, one each for a plurality of said top rollers and for a plurality of said bottom rollers.

12. A drafting unit according to claim 11, wherein said top and bottom rollers are arranged in respective essentially verticle rows.

13. A drafting unit according to claim 3, wherein two of said cleaning belts are provided, one each for a plurality of said top rollers and for a plurality of said bottom rollers.

14. A drafting unit according to claim 7, wherein two of said cleaning belts are provided, one each for a plurality of said top rollers and for a plurality of said bottom rollers.

15. A drafting unit according to claim 2, wherein two of said cleaning belts are provided, one each for a plurality of said top rollers and for a plurality of said bottom rollers.

16. A drafting unit according to claim 1, wherein the bottom drafting rollers are disposed essentially vertically one above the other, wherein the top drafting rollers are disposed essentially vertically one above the other, and wherein one of said continuous cleaning belts is provided for each of said sets of top and bottom drafting rollers.

17. A drafting unit according to claim 16, wherein a first cleaning belt drive shaft is provided in driving engagement with the top deflecting roller of the continuous cleaning belt for the top drafting rollers, and wherein a second cleaning belt drive shaft is provided in driving engagement with the top deflecting roller of the continuous cleaning belt for the bottom drafting rollers.

18. A drafting unit according to claim 17, wherein the top deflecting rollers are provided with ring collars for drivingly engaging the respective belt drive shafts.

19. A drafting unit according to claim 18, wherein the top deflecting rollers are supported in respective guides which exhibit guide surfaces extending diagonally with respect to the associated cleaning belt drive shaft in driving engagement with the associated top deflecting roller.

* * * * *